US005466118A

United States Patent [19]

Heinrich

[11] Patent Number: 5,466,118

[45] Date of Patent: Nov. 14, 1995

[54] CENTRIFUGAL COMPRESSOR WITH A FLOW-STABILIZING CASING

[75] Inventor: Klaus Heinrich, Nussbaumen, Switzerland

[73] Assignee: ABB Management Ltd., Baden, Switzerland

[21] Appl. No.: 191,523

[22] Filed: Feb. 4, 1994

[30] Foreign Application Priority Data

Mar. 4, 1993 [DE] Germany ..... 43 06 689.5

[51] Int. Cl.[6] ..... F04D 29/42

[52] U.S. Cl. ..... 415/58.6; 415/208.3; 415/58.2

[58] Field of Search ..... 415/52.1, 58.1, 415/58.2, 58.3, 58.6, 208.3, 211.1

[56] References Cited

U.S. PATENT DOCUMENTS

| | | | |
|---|---|---|---|
| 4,063,848 | 12/1977 | Wiggins et al. | 415/58.6 |
| 4,212,585 | 7/1980 | Swarden et al. | 415/58.6 |
| 4,594,052 | 6/1986 | Niskanen | 416/185 |
| 4,743,161 | 5/1988 | Fisher et al. | 415/58.3 |
| 4,781,530 | 11/1988 | Lauterbach et al. | 415/58.6 |
| 5,236,301 | 8/1993 | Palmer | 415/208.3 X |
| 5,277,541 | 1/1994 | Palmer | 415/58.3 X |

FOREIGN PATENT DOCUMENTS

| | | | |
|---|---|---|---|
| 0348674 | 1/1990 | European Pat. Off. | 415/58.6 |
| 55-35173 | 3/1980 | Japan | 415/58.6 |
| 1756646 | 8/1992 | U.S.S.R. | 415/183 |

*Primary Examiner*—Edward K. Look
*Assistant Examiner*—Michael S. Lee
*Attorney, Agent, or Firm*—Burns, Doane, Swecker & Mathis

[57] ABSTRACT

A centrifugal compressor with a flow-stabilizing casing includes an impeller (2) rotatably supported about a machine axis (7) and having a hub (9) with a plurality of impeller vanes (3) on its periphery; a compressor casing (4), which encloses the impeller, whose inner casing contour (4*a*) is matched to the outer contour of the impeller vanes (3) and, together with the hub (9), forms a flow duct extending between an axial inlet (10) and a radial outlet (11); and a plurality of elongated stabilizer slots (5), which extend in the flow direction in the inlet region of the flow duct, penetrate from the inner casing contour (4*a*) into the casing (4) and are distributed over the inner periphery of the casing (4). In order to extend the stable working range to smaller volume flows, the stabilizer slots (7) are arranged relative to the impeller vanes (3) in such a way that their front end facing toward the axial inlet (10) is located at a predetermined distance downstream of the vane leading edge (6).

14 Claims, 3 Drawing Sheets

CENTRIFUGAL COMPRESSOR WITH A FLOW-STABILIZING CASING

BACKGROUND OF THE INVENTION

1. Field of the Invention

The present invention relates to the field of centrifugal compressors. It concerns a centrifugal compressor with a flow-stabilizing casing, including (a) an impeller rotatably supported about a machine axis and having a hub with a plurality of impeller vanes on its periphery;

(b) a compressor casing, which encloses the impeller, whose inner casing contour is matched to the outer contour of the impeller vanes and, together with the hub, forms a flow duct extending between an axial inlet and a radial outlet; and (c) a plurality of elongated stabilizer slots, which extend in the flow direction in the inlet region of the flow duct, penetrate from the inner casing contour into the casing and are distributed over the inner periphery of the casing.

A radial compressor of this type is, for example, known from U.S. Pat. No. 4,212,585 to Swarden et al.

2. Discussion of Background

In centrifugal compressors, the stable operating range is limited, in the case of severe throttling in the direction of small volume flows, by the so-called "surge line". Reliable operation of the compressor is no longer possible beyond this surge line. In addition, very severe mechanical loads occur on all the components due to the unsteady flow and these loads can lead to damage to the compressor or even to its destruction.

For many applications, there is great interest in displacing the surge line of a centrifugal compressor to smaller volume flows in order to increase the stable working range of the compressor. A precondition for this is knowledge of the causes which are decisive for the appearance of a surge line and determine its position.

There are numerous experimental and theoretical investigations of the phenomenon of the collapse of stable flow through the compressor. To a great extent, specialists agree that a recirculation vortex, which forms in the front impeller region when the compressor is throttled, participates to a large extent in the initiation of surging. All the known designs for displacing the surge line therefore attempt to suppress or influence this vortex.

A solution designated as a "casing treatment" is described in U.S. Pat. No. 4,212,585. It is characterized, as shown in the diagrammatic representation of FIG. 1, by a plurality of narrow stabilizer slots 5 in the compressor casing 4. The stabilizer slots 5 begin at the leading edges 6 of the impeller vanes 3 of the vane 2 or even a short distance upstream of them. The slots 5 are inclined in the direction of rotation of the impeller 2 and are, in some cases, arranged obliquely to the machine axis 7. The slots have a rectangular shape in meridional section, the front wall 5*a* and the rear wall 5*c* being oriented approximately at right angles to the machine axis 7.

In the known design, the displacement of the surge line occurs mainly in the upper region of the compressor characteristic diagram. In the lower speed range, on the other hand, this form of casing treatment provides no improvement. To the contrary, there may even be a deterioration in the lower speed range. This form of casing treatment is therefore suitable for compressors which are operated at a rotational speed which only fluctuates slightly from the nominal value. It is unsuitable for compressors which operate with a strongly varying rotational speed, such as compressors in exhaust gas turbochargers, because of the stability problems, already mentioned, at low rotational speed.

SUMMARY OF THE INVENTION

Accordingly, one object of the invention is to provide a centrifugal compressor with a novel flow-stabilizing casing which displaces the surge line to smaller volume flows over the whole of the characteristic diagram range.

The object is achieved in a compressor of the type mentioned at the beginning wherein (d) the stabilizer slots are arranged relative to the impeller vanes in such a way that their front end facing toward the axial inlet is located at a predetermined distance downstream of the vane leading edge.

The core of the invention consists in arranging the stabilizer slots in such a way that the recirculation vortices, which form with increasing throttling, can be influenced by the slots even before the vortices are fully developed.

A first preferred embodiment of the compressor according to the invention has the feature that the rear end of the stabilizer slots is located in the region of the beginning of the deflection from the axial inlet flow to the radial outlet flow. This ensures that the vortices reach the influence region of the slots even during their formation.

A second preferred embodiment of the compressor according to the invention has the feature that the impeller vanes include main vanes extending from the axial inlet to the radial outlet and shorter intermediate vanes located between the main vanes and only beginning after the axial inlet, and that the rear end of the stabilizer slots is located in the region where the intermediate vanes begin. This permits the advantages of the previous embodiment to be achieved even in the case of impellers with impeller vanes of different lengths.

Further advantages arise with respect to stabilization when the shape of the slots is aerodynamically matched to the conditions in the recirculation vortex. In accordance with a further preferred embodiment of the invention, this is achieved by the feature that the stabilizer slots respectively have a bottom extending straight in the flow direction, which bottom is oriented approximately tangentially to the adjacent outer contour of the impeller vanes, that the stabilizer slots are respectively bounded at the rear end by a rear wall which extends flatter than the local normal to the inner casing contour and, together with this normal, encloses an acute angle ($\gamma$), and by the feature that the rear wall respectively merges with continuous tangent into the bottom.

Further embodiments are given by the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
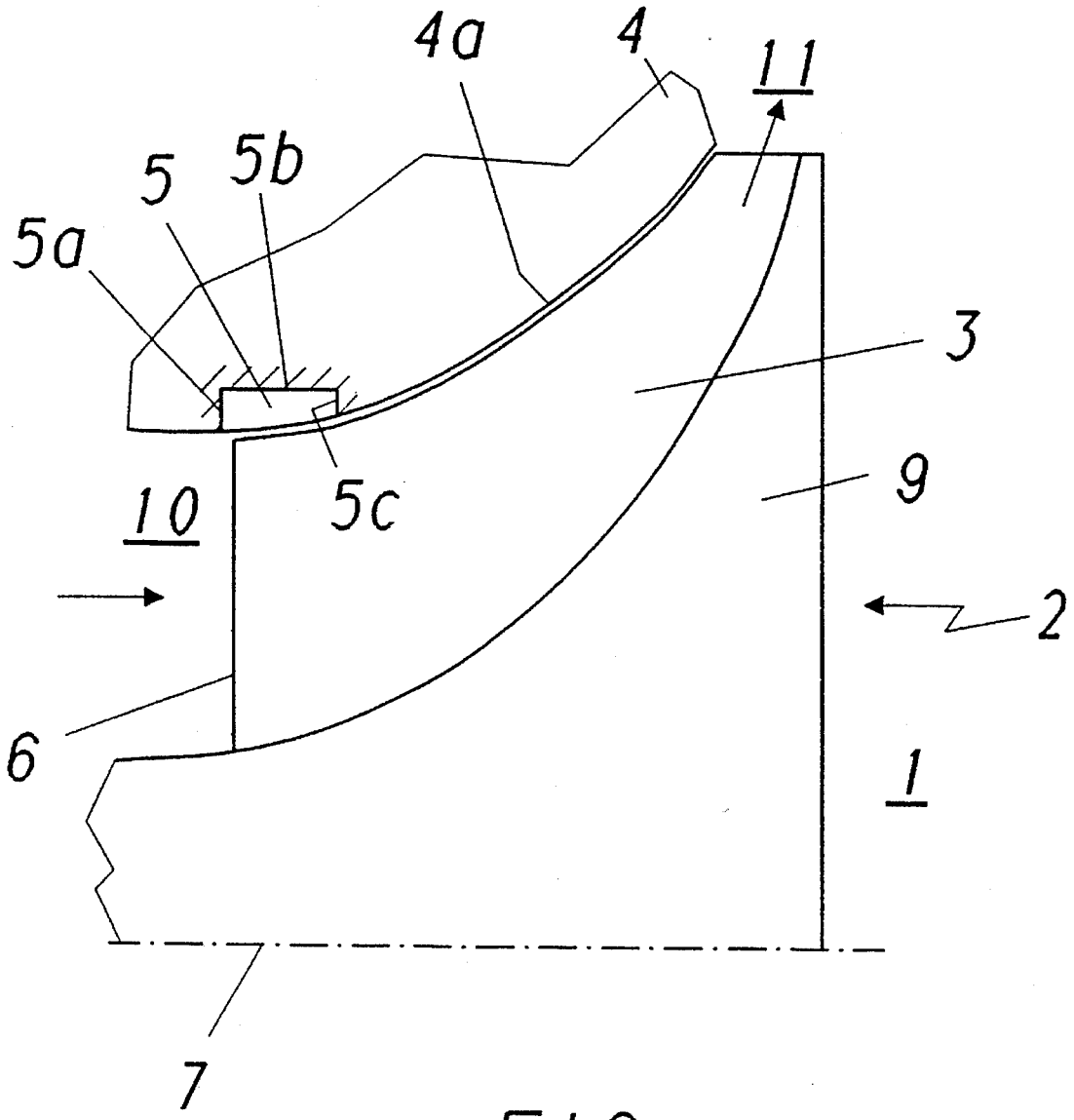
FIG. 1 shows, in a diagrammatic cross-sectional representation, a compressor with a stabilizing "casing treatment" in accordance with the prior art.

Referring now to the drawings, wherein like reference numerals designate identical or corresponding parts throughout the several views, the prior art, as is U.S. Pat. No. 4,212,585, is first of all briefly explained using FIG. 1 in order to clarify the differences between the invention and the prior art. The known centrifugal compressor with stabilizing casing includes an impeller 2, which is rotatably supported on a machine axis 7 and which carries a plurality of impeller vanes 3 on a hub 9, which impeller vanes are arranged on the periphery of the hub 9 at uniform angular distances apart. The impeller is accommodated in a compressor casing 4 (only indicated as excerpt in FIG. 1). The compressor casing 4 has, on the inside, an inner casing contour 4*a* which is matched to the outer contour of the impeller vanes 3. The inner casing contour 4*a* and the hub 9 form a flow duct for the medium to be compressed, which duct leads from an axial inlet 10 to a radial outlet 11, the medium being successively deflected from an axial inlet flow to a radial outlet flow in a central region of the flow duct.

The known casing treatment includes a plurality of stabilizer slots 5 which are arranged on the inner periphery of the casing at uniform angular distances apart and in the region of the vane leading edge 6. The stabilizer slots 5, which are elongated in the direction of the machine axis 7, have a substantially rectangular cross-section in the meridional plane and are bounded at the front and rear ends by a front wall 5*a* and a rear wall 5*c*, respectively, which are each oriented at right angles to the machine axis 7. In this arrangement, the front wall 5*a* is located upstream of the vane leading edge 6. The outer boundary in the radial direction is provided by a bottom 5*b* extending parallel to the machine axis 7.

As already mentioned, the stabilizing effect of the slots in the inner casing wall is based on influencing the recirculation vortex in the front region of the impeller—the vortex is displaced out of the impeller into the slots and its influence on the main flow is therefore diminished. As more recent experimental investigations have shown, however, the vortex does not appear directly at the vane leading edges 6 of the impeller 2. It occurs, rather, downstream of the vane leading edge 6 in the region of the beginning of the deflection from the axial inlet flow to the radial outlet flow or in the region of the leading edges of the intermediate vanes (when the impeller vanes are subdivided into main vanes and intermediate vanes). It is only in the case of severe throttling that the recirculation vortex grows as far as the vane leading edges 6 (which, in the case of vanes subdivided into longer main vanes and shorter intermediate vanes, are also the leading edges of the main vanes). For these reasons, it is only the fully developed vortex which can be influenced by the form of casing treatment represented in FIG. 1.

In the known casing treatment, however, it is not only the beginning position of the slots at the vane leading edge 6, or upstream of it, which is not matched to the position of the vortex in an optimum manner. The same also applies to the form of the slots in the meridional plane—the rectangular shape with the front and rear walls 5*a* and 5*c* respectively oriented at right angles to the machine axis 7 does not offer good preconditions for the flow of the recirculation vortex into the slots and for its motion in them.

In order to displace the surge line to smaller volume flows over the whole rotational speed range of the compressor, the position of the stabilizing slots must, therefore, first of all be matched in an optimum manner to the position and shape of the recirculation vortex. In the second place, it should be possible for even the weak vortex, which is just being initiated, to flow into the slots. For this purpose, the contour of the slots should be shaped in such a way that the slots possess the smallest possible hydraulic resistance.

Figure 2:
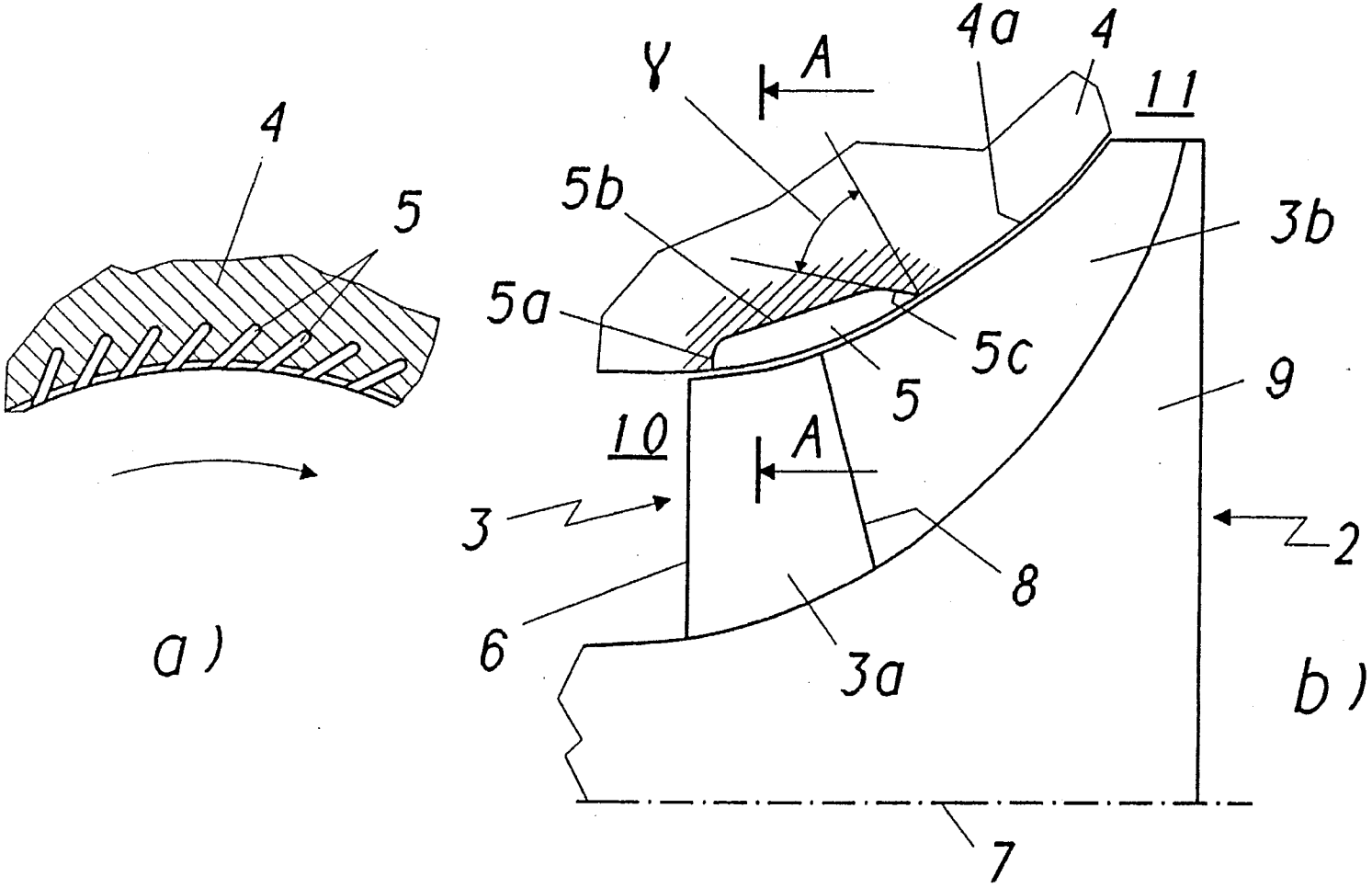
FIG. 2 shows a first preferred embodiment example of a compressor with stabilization slots in accordance with the invention in a representation (b) analogous to FIG. 1 and in section along the plane A—A (a) indicated in FIG. 2(*b*)

A first preferred embodiment example of such an optimized casing treatment is given in FIG. 2. Although this is not imperative, the impeller vanes 3 are each subdivided, in this example, into longer main vanes 3*a*, which extend from the axial inlet 10 to the radial outlet 11, and shorter intermediate vanes 3*b* whose own leading edge 8 is downstream of the leading edge 6, of the main vanes 3*a*. It is not only the position of the stabilizer slots 5 but also their shape which is modified relative to the prior art. Their front end facing toward the axial inlet 10, i.e. their front wall 5*a*, is located at a predetermined distance downstream of the main vane leading edge 6.

The rear end of the slots is placed in the region of the deflection from the axial inlet flow into the radial outlet flow which, in the distribution of the impeller vanes 3 shown in FIG. 2(*b*), has the same significance as the region directly behind the leading edge 8 of the intermediate vanes 3*b*. The optimum position and length of the stabilizer slots 5 can be easily found by the specialist after computational or experimental determination of the position and size of the recirculation vortex. As can be seen from the cross-section shown in FIG. 2(*a*) along the line A—A in FIG. 2(*b*), the slots can be additionally arranged so that they are inclined in the direction of rotation of the impeller 2.

In addition to the modified position and length of the stabilizer slots 5, there is also a change in the shape relative to the prior art. Although the front wall 5*a* remains substantially at right angles to the machine axis 7 in the example of FIG. 2(*b*), the straight bottom 5*b* is no longer parallel to the machine axis. The bottom 5*b* extends in the flow direction, but now is approximately tangential to the adjacent outer contour of the impeller vanes (3) and is therefore oriented to the recirculation vortex. In addition, the stabilizer slots 5 are each bounded at the rear end by a rear wall 5*c* which extends relative to a normal to the inner casing contour 4*a* at an acute angle ($\gamma$), the size of this angle being likewise made to suit the conditions in the vortex, which have to be found. Finally, the right-angle corners—which are not hydrodynamically optimum—in the slot contour are avoided because the front wall 5*a* and the rear wall 5*c* of the slots are formed with a curvature that merges into the bottom 5*b*. By means of all the measures described, the recirculation vortex is better influenced and stabilized outside the impeller 2 at an earlier stage of the formation of the vortex, and also overall.

Figure 3:
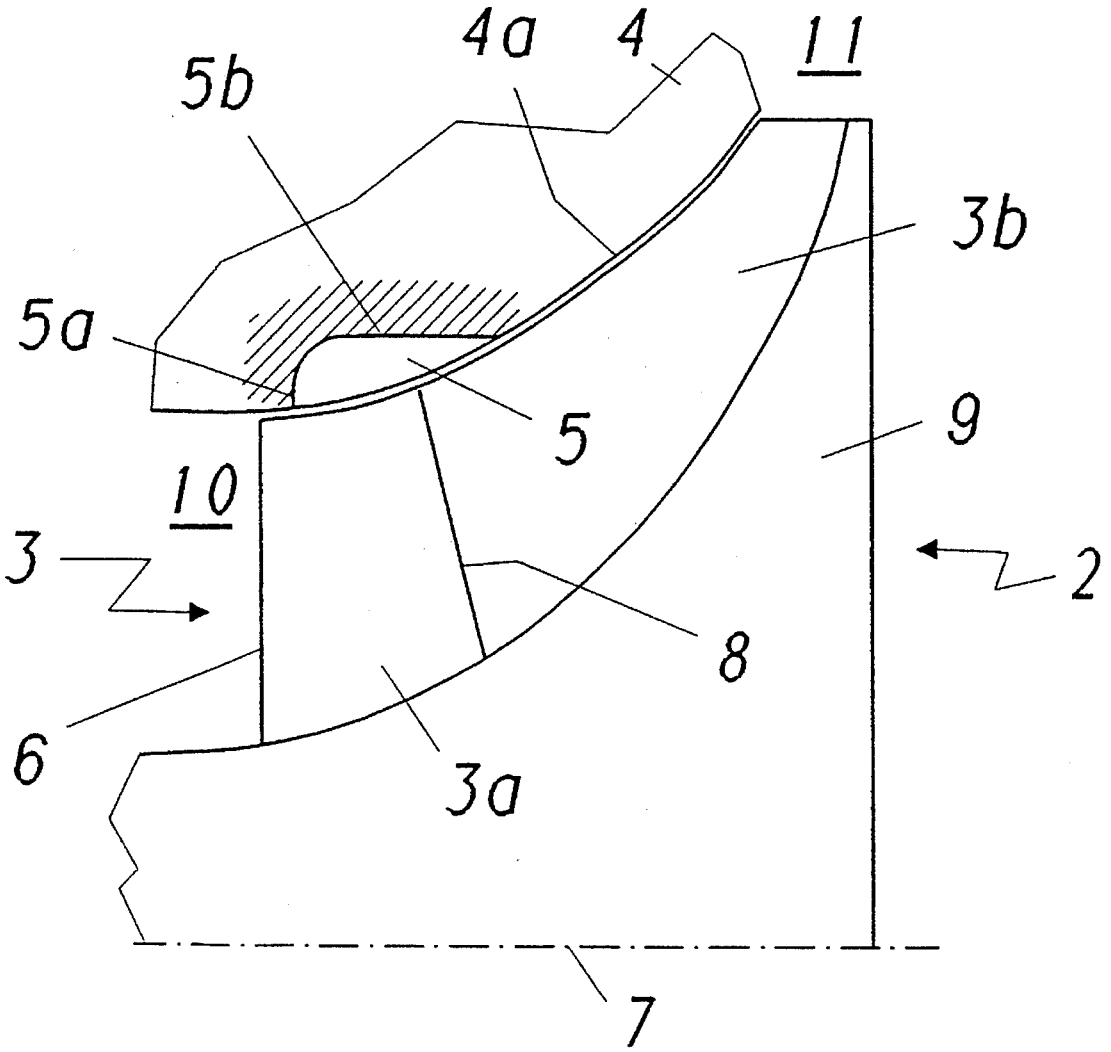
FIG. 3 shows a second preferred embodiment example comparable with FIG. 2(*b*) with a different slot shape.

In a further embodiment example given in FIG. 3, the shape of the stabilizer slots 5 is simplified, relative to the example of FIG. 2, at an approximately unaltered position. There is no longer any rear wall. The bottom 5*b* of the slots at the rear end extends, rather, in a wedge shape into the inner casing contour 4*a*. This provides simplified manufacture of the slots with a similarly good influence on the vortex.

Overall, the invention makes available a centrifugal compressor which has the feature of a marked extension to the stable working range toward small volume flows over the whole characteristic diagram range.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A centrifugal compressor with a flow-stabilizing casing, comprising:

(a) an impeller rotatably supported about a machine axis and having a hub with a plurality of impeller vanes mounted on a periphery;

(b) a compressor casing, which encloses the impeller, an inner casing contour being matched to an outer contour of the impeller vanes, the inner casing contour and the hub defining a flow duct extending between an axial inlet and a radial outlet; and (c) a plurality of elongated stabilizer slots formed in the casing on an inner surface of the casing, each of the stabilizer slots having a bottom extending in a flow direction in the inlet region of the flow duct, and being distributed over an inner periphery of the inner casing contour; wherein (d) each stabilizer slot is positioned relative to the impeller vanes so that a front end toward the axial inlet is located at a predetermined distance downstream of a vane leading edge.

2. The centrifugal compressor as claimed in claim 1, wherein a rear end of each stabilizer slot is located in a region of the flow duct where the flow duct is shaped to begin a deflection from an axial inlet flow direction to a radial outlet flow direction.

3. The centrifugal compressor as claimed in claim 1, wherein the bottom of each stabilizer slot is oriented approximately parallel to a tangent to the adjacent outer contour of the impeller vanes.

4. The centrifugal compressor as claimed in claim 3, wherein each stabilizer slot is bounded at a rear end by a rear wall which extends at an acute angle to a local normal to the inner casing contour.

5. The centrifugal compressor as claimed in claim 4, wherein the rear wall is formed with a curvature that merges into the bottom.

6. The centrifugal compressor as claimed in claim 1, wherein each stabilizer slot has a bottom extending in the flow direction, which bottom is formed as a wedge shape in the inner casing contour at a rear end of the slot.

7. The centrifugal compressor as claimed in claim 1, wherein each stabilizer slot is bounded at a front end by a front wall which is formed with a curvature that merges into a bottom extending in the flow direction.

8. The centrifugal compressor as claimed in claim 1, wherein the stabilizer slots are arranged so that they are inclined in the direction of rotation of the impeller.

9. A centrifugal compressor with a flow-stabilizing casing, comprising:

an impeller rotatably supported about a machine axis and having a hub with a plurality of impeller vanes mounted on a periphery;

a compressor casing, which encloses the impeller, an inner casing contour being matched to an outer contour of the impeller vanes, the inner casing contour and the hub defining a flow duct extending between an axial inlet and a radial outlet;

the impeller vanes including main vanes extending from the axial inlet to the radial outlet and shorter intermediate vanes located between main vanes and having a leading edge downstream of the axial inlet; and a plurality of elongated stabilizer slots formed in the casing on an inner surface of the casing, the stabilizer slots extending in the flow direction in the inlet region of the flow duct, and being distributed over an inner periphery of the inner casing contour; wherein each stabilizer slot is positioned relative to the impeller vanes so that a front end toward the axial inlet is located at a predetermined distance downstream of a vane leading edge and a rear end is located in a region of the leading edge of the intermediate vanes.

10. A centrifugal compressor with a flow-stabilizing casing, comprising:

(a) an impeller rotatably supported about a machine axis and having a hub with a plurality of impeller vanes mounted on a periphery;

(b) a compressor casing, which encloses the impeller, an inner casing contour being matched to an outer contour of the impeller vanes, the inner casing contour and the hub defining a flow duct extending between an axial inlet and a radial outlet; and (c) a plurality of elongated stabilizer slots formed in the casing on an inner surface of the casing, each of the stabilizer slots having a bottom extending in a flow direction in the inlet region of the flow duct and parallel to a tangent to the adjacent outer contour of the impeller vanes, and being distributed over an inner periphery of the inner casing contour;

wherein (d) each stabilizer slot is positioned relative to the impeller vanes so that a front end toward the axial inlet is located at a predetermined distance downstream of a vane leading edge.

11. The centrifugal compressor as claimed in claim 10, wherein each stabilizer slot is bounded at a rear end by a rear wall which extends at an acute angle to a local normal to the inner casing contour.

12. The centrifugal compressor as claimed in claim 11, wherein the rear wall is formed with a curvature that merges into the bottom.

13. The centrifugal compressor as claimed in claim 10, wherein each stabilizer slot has a bottom extending in the flow direction, which bottom is formed as a wedge shape in the inner casing contour at a rear end of the slot.

14. The centrifugal compressor as claimed in claim 10, wherein each stabilizer slot is bounded at a front end by a front wall which is formed with a curvature that merges into a bottom extending in the flow direction.

* * * * *